US010787859B2

(12) United States Patent
Huang

(10) Patent No.: US 10,787,859 B2
(45) **Date of Patent: *Sep. 29, 2020**

(54) RETRACTING MEANS FOR RETRACTING CURTAIN CORD AND RETRACTABLE CURTAIN

(71) Applicant: Suzhou Hongren Window Decorations Co., Ltd., Taicang, Jiangsu (CN)

(72) Inventor: Jiehren Huang, Taicang (CN)

(73) Assignee: Suzhou Hongren Window Decorations Co., Ltd., Taicang, Jiangsu (CN)

( * ) Notice: Subject to any disclaimer, the term of this patent is extended or adjusted under 35 U.S.C. 154(b) by 261 days.

This patent is subject to a terminal disclaimer.

(21) Appl. No.: 15/751,818

(22) PCT Filed: Sep. 12, 2016

(86) PCT No.: PCT/CN2016/098755

§ 371 (c)(1),
(2) Date: Feb. 9, 2018

(87) PCT Pub. No.: WO2018/018718

PCT Pub. Date: Feb. 1, 2018

(65) Prior Publication Data

US 2018/0230744 A1 Aug. 16, 2018

(30) Foreign Application Priority Data

Jul. 25, 2016 (CN) ..... 2016 1 0585377

(51) Int. Cl.

| | |
|---|---|
| ***E06B 9/322*** | (2006.01) |
| ***E06B 9/38*** | (2006.01) |
| ***E06B 9/262*** | (2006.01) |

(52) U.S. Cl.

CPC ..... *E06B 9/38* (2013.01); *E06B 9/262* (2013.01); *E06B 9/322* (2013.01);
(Continued)

(58) Field of Classification Search

CPC ..... E06B 2009/3222; E06B 2009/3225; E06B 9/322; E06B 9/262; E06B 9/368; E06B 9/60

See application file for complete search history.

(56) References Cited

U.S. PATENT DOCUMENTS 5,133,399 A * 7/1992 Hiller ..... E06B 9/30 160/170
5,328,113 A 7/1994 Somfy
(Continued)

FOREIGN PATENT DOCUMENTS

CN 1828002 9/2006
CN 2865497 2/2007
(Continued)

OTHER PUBLICATIONS

International Search Report for Application No. PCT/CN2016/098755, dated Apr. 27, 2017 in 8 pages.

*Primary Examiner* — Johnnie A. Shablack
(74) *Attorney, Agent, or Firm* — Knobbe, Martens, Olson & Bear, LLP

(57) ABSTRACT

A retracting means comprises a synchronizing wheel group and transmission assemblies, the transmission assembly at each side being connected with a winding assembly; each transmission assembly comprises a first bevel gear and a second bevel gear which are engaged with each other, and the first bevel gear is connected with at least one synchronizing wheel; each winding assembly comprises a fixing seat, a winding shaft and a transmission shaft, the transmission shaft is connected with a corresponding second bevel gear, the winding shaft passes though and is coaxial with the transmission shaft, the outer wall of the winding shaft tilts outward gradually along the axis of the transmission shaft.

10 Claims, 9 Drawing Sheets

(52) U.S. Cl.
CPC ..... *E06B 2009/2622* (2013.01); *E06B 2009/3222* (2013.01); *E06B 2009/3225* (2013.01)

(56) References Cited

U.S. PATENT DOCUMENTS

| | | | | |
|---|---|---|---|---|
| 6,536,503 | B1 * | 3/2003 | Anderson | E06B 9/262 160/170 |
| 7,025,107 | B2 * | 4/2006 | Ciuca | E06B 9/303 160/170 |
| 7,389,956 | B2 * | 6/2008 | Hung | E06B 9/322 160/170 |
| 7,866,367 | B2 * | 1/2011 | Liang | E06B 9/307 160/170 |
| 8,002,012 | B2 * | 8/2011 | Cheng | E06B 9/303 160/170 |
| 8,459,328 | B2 * | 6/2013 | Anderson | E06B 9/262 160/171 |
| 8,820,385 | B2 * | 9/2014 | Wu | E06B 9/322 160/170 |
| 8,887,788 | B2 * | 11/2014 | Toti | E06B 9/322 160/170 |
| 8,950,461 | B2 * | 2/2015 | Adams | E06B 9/32 160/84.02 |
| 9,157,273 | B2 * | 10/2015 | Dekker | E06B 9/322 |
| 9,366,076 | B2 * | 6/2016 | Hung | E06B 9/322 |
| 9,366,077 | B2 * | 6/2016 | Chen | F16H 31/001 |
| 9,482,049 | B2 * | 11/2016 | Chen | E06B 9/322 |
| 9,752,380 | B2 * | 9/2017 | Anderson | E06B 9/262 |
| 9,976,345 | B2 * | 5/2018 | Chen | E06B 9/322 |
| 10,494,862 | B2 * | 12/2019 | Zhang | E06B 9/32 |
| 10,494,864 | B2 * | 12/2019 | Adams | H04W 52/0277 |
| 2004/0144500 | A1 | 7/2004 | Nien | |
| 2006/0042763 | A1 * | 3/2006 | Le Ru | E06B 9/308 160/171 |
| 2006/0144527 | A1 | 7/2006 | Toti | |
| 2006/0162870 | A1 * | 7/2006 | Nien | E06B 9/262 160/84.01 |
| 2007/0029051 | A1 | 2/2007 | Nien et al. | |
| 2007/0261798 | A1 | 11/2007 | Hung et al. | |
| 2008/0083512 | A1 * | 4/2008 | Hsu | E06B 9/322 160/170 |
| 2008/0087386 | A1 * | 4/2008 | Nien | E06B 9/322 160/170 |
| 2008/0099157 | A1 * | 5/2008 | Nien | E06B 9/322 160/84.05 |
| 2008/0210387 | A1 * | 9/2008 | Yang | E06B 9/322 160/168.1 V |
| 2009/0255637 | A1 * | 10/2009 | Yu | E06B 9/322 160/331 |
| 2009/0256021 | A1 * | 10/2009 | Dorrough | E06B 9/303 242/397 |
| 2009/0321022 | A1 * | 12/2009 | Yu | E06B 9/322 160/84.05 |
| 2015/0176329 | A1 * | 6/2015 | Chen | E06B 9/322 160/176.1 R |
| 2015/0354271 | A1 * | 12/2015 | Hsu | E06B 9/322 160/173 R |
| 2016/0230453 | A1 * | 8/2016 | Chen | E06B 9/322 |
| 2016/0298385 | A1 * | 10/2016 | Chen | E06B 9/322 |
| 2017/0081914 | A1 * | 3/2017 | Wu | E06B 9/266 |
| 2018/0230739 | A1 * | 8/2018 | Huang | E06B 9/322 |
| 2018/0230744 | A1 * | 8/2018 | Huang | E06B 9/262 |
| 2018/0230745 | A1 * | 8/2018 | Huang | E06B 9/324 |
| 2019/0071925 | A1 * | 3/2019 | Zhang | E06B 9/307 |
| 2019/0085622 | A1 * | 3/2019 | Lin | E06B 9/322 |

FOREIGN PATENT DOCUMENTS

| | | | | |
|---|---|---|---|---|
| CN | 200948043 | | 9/2007 | |
| CN | 200996260 | | 12/2007 | |
| CN | 101173593 | | 5/2008 | |
| CN | 201076336 | | 6/2008 | |
| CN | 201771402 | | 3/2011 | |
| CN | 202031462 | | 11/2011 | |
| CN | 202706868 | | 1/2013 | |
| CN | 203978234 | | 12/2014 | |
| CN | 104847244 | | 8/2015 | |
| CN | 204743671 | | 11/2015 | |
| CN | 205000874 | | 1/2016 | |
| CN | 105525853 | | 4/2016 | |
| CN | 205153964 | | 4/2016 | |
| CN | 205162690 | | 4/2016 | |
| CN | 106050108 | | 10/2016 | |
| CN | 106050110 | | 10/2016 | |
| CN | 106089002 | | 11/2016 | |
| CN | 205805377 | | 12/2016 | |
| CN | 205876133 | | 1/2017 | |
| CN | 205876134 | | 1/2017 | |
| CN | 205876135 | | 1/2017 | |
| EP | 1748144 | | 1/2007 | |
| GB | 2437962 | A * | 11/2007 | E06B 9/322 |
| JP | H0451284 | | 4/1992 | |
| JP | 2006070448 | | 3/2006 | |
| JP | 2015202130 | | 11/2015 | |
| TW | M255316 | | 1/2005 | |
| WO | WO 2014169172 | | 10/2014 | |

* cited by examiner

RETRACTING MEANS FOR RETRACTING CURTAIN CORD AND RETRACTABLE CURTAIN

TECHNICAL FIELD OF THE INVENTION

The present disclosure relates to the curtain field and in particular to a retractor for retracting a curtain cord and a retractable curtain.

BACKGROUND OF THE INVENTION

Retracting of retractable curtains such as Roman curtains is generally achieved via cords at two sides of the curtain bodies at least, and the cords are wound or unwound by a retractor. In the prior art, the retractor comprises synchronizing wheels and winding shafts for winding the cords, the winding shaft and one of the synchronizing wheels are coaxially provided, a coil spring is wound around the synchronizing wheels to provide reset force, the cords are stacked and wound on the winding shaft, pass through the curtain body from the upper end to the lower end, and are stacked and wound on the winding shaft via several line guiding wheels after passing through the upper end of the curtain body. In actual use, uneven problem occurs on the cords at two sides, diameters of the turns on the winding shaft will gradually change and cause the unbalance of the two sides of the curtain body; the cords on the winding shaft are very easy to get intertwined and tied, and retracting the curtain takes too much effort, or can not be achieved due to completely getting stuck, which is inconvenient for use; the structure is not rational and compact enough.

SUMMARY OF THE INVENTION

To solve the above mentioned problems, it is an object of the present disclosure to provide a retractor for retracting a curtain cord and a retractable curtain, which avoids stacking or intertwining of the cord and has a compact structure.

According to a first aspect of the present disclosure, a retractor for retracting a curtain cord is provided, which comprises a synchronizing wheel group and transmission assemblies located at two sides of the synchronizing wheel group for changing the transmission direction, and the transmission assembly at each side is connected with a winding assembly;

the synchronizing wheel group comprises at least one coil spring and at least two synchronizing wheels, and two ends of each coil spring are fixedly connected to two synchronizing wheels respectively so as to be wound on the two synchronizing wheels in opposite winding directions;

each transmission assembly comprises a first bevel gear and a second bevel gear which are engaged with each other, and the first bevel gears of the two transmission assemblies are connected with at least one synchronizing wheel;

each winding assembly comprises a fixing seat, and a winding shaft and a transmission shaft which are rotatably provided on the fixing seat, the transmission shaft is connected with a corresponding second bevel gear, the transmission shaft passes though and is coaxial with the winding shaft, the outer wall of the winding shaft tilts outward gradually along the axis of the transmission shaft, and a threading hole for the cord to pass through is opened on a part of the fixing seat corresponding to one end of the winding shaft with a larger outer diameter;

the extending directions of the rotating axis of the synchronizing wheel and the axis of the transmission shaft are different.

According to a second aspect of the present disclosure, a retractor for retracting a curtain cord is provided, which comprises a synchronizing wheel group, transmission assemblies located at two sides of the synchronizing wheel group for changing the transmission direction, and winding assemblies connected with the transmission assemblies at the two sides, and the transmission assembly at at least one side of the synchronizing wheel group is connected with at least two winding assemblies;

the synchronizing wheel group comprises at least one coil spring and at least two synchronizing wheels, and two ends of each coil spring are fixedly connected to two synchronizing wheels respectively so as to be wound on the two synchronizing wheels in opposite winding directions;

each transmission assembly comprises a first bevel gear and a second bevel gear which are engaged with each other, and the first bevel gears of the two transmission assemblies are connected with at least one synchronizing wheel;

each winding assembly comprises a fixing seat, and a winding shaft and a transmission shaft which are rotatably provided on the fixing seat, the transmission shaft is connected with a corresponding second bevel gear, the transmission shaft passes though and is coaxial with the winding shaft, the outer wall of the winding shaft tilts outward gradually along the axis of the transmission shaft, and a threading hole for the cord to pass through is opened on a part of the fixing seat corresponding to one end of the winding shaft with a larger outer diameter; the transmission shafts at the same side are coaxial;

the extending directions of the rotating axis of the synchronizing wheel and the axis of the transmission shaft are different.

According to a third aspect of the present disclosure, a retractor for retracting a curtain cord is provided, which comprises a plurality of synchronizing wheel groups and a plurality of winding assemblies, two sides of each of the synchronizing wheel groups are provided with transmission assemblies for changing the transmission direction, and the transmission assemblies at two sides of each of the synchronizing wheel groups are connected with at least one winding assemblies, respectively;

the synchronizing wheel group comprises at least one coil spring and at least two synchronizing wheels, and two ends of each coil spring are fixedly connected to two synchronizing wheels respectively so as to be wound on the two synchronizing wheels in opposite winding directions;

each transmission assembly comprises a first bevel gear and a second bevel gear which are engaged with each other, and the first bevel gears of the two transmission assemblies are connected with at least one synchronizing wheel;

each winding assembly comprises a fixing seat, and a winding shaft and a transmission shaft which are rotatably provided on the fixing seat, the transmission shaft is connected with a corresponding second bevel gear, the transmission shaft passes though and is coaxial with the winding shaft, the outer wall of the winding shaft tilts outward gradually along the axis of the transmission shaft in a gradually outward manner, and a threading hole for the cord to pass through is opened on a part of the fixing seat corresponding to one end of the winding shaft with a larger outer diameter;

the extending directions of the rotating axis of the synchronizing wheel and the axis of the transmission shaft are different.

Preferably, the synchronizing wheel and the first bevel gear are uncoaxial, and the first bevel gear and the synchronizing wheel are connected via a cylindrical gear. The size of the retractor in the thickness direction is reduced to cause a compact structure.

Preferably, the synchronizing wheel group comprises at least two groups of synchronizing wheels and at least one coil spring, each group of synchronizing wheels comprises at least two synchronizing wheels, all synchronizing wheels in each group of synchronizing wheels are coaxial and are successively arranged along the rotating axis thereof, and one end of the coil spring is connected to one synchronizing wheel in one group of the synchronizing wheels, and the other end is connected to one synchronizing wheel in another group of the synchronizing wheels. The numbers of each group of the synchronizing wheels and the number of the coils may be increased or reduced according to the weight of the curtain body.

Preferably, the synchronizing wheel group comprises at least a pair of synchronizing wheels, and one coil spring is wound on each pair of synchronizing wheels. The numbers of the synchronizing wheels and the number of the coils may be increased or reduced according to the weight of the curtain body.

More preferably, the synchronizing wheels comprise at least three synchronizing wheels, at least the synchronizing wheel located in the middle is stacked and wounded with two coil springs to drive the synchronizing wheels at two sides thereof respectively. The numbers of each group of the synchronizing wheels and the number of the coils may be increased or reduced according to the weight of the curtain body.

Preferably, the outer wall of the synchronizing wheel is provided with a circle of gear teeth, and the synchronizing wheels are engaged with each other via the gear teeth, and two synchronizing wheels at two sides are connected with the first bevel gears at corresponding sides, respectively.

Preferably, the rotating axis of the synchronizing wheel and the axis of the transmission shaft are perpendicular to each other.

Preferably, the section of the transmission shaft is a polygon, the winding shaft has a hole matched with the polygon, and the transmission shaft passes through the hole.

Preferably, the fixing seat is opened with a plurality of guiding holes, the plurality of guiding holes are opened at different positions of the fixing seat, and the threading hole is located between the guiding holes and the outer wall of the winding shaft.

Preferably, the extending directions of the rotating axes of the transmission shafts of the respective winding assemblies are the same.

More preferably, the retractor further comprises a support for connecting to the curtain body and a mounting base for mounting the synchronizing wheels and the transmission assemblies, the mounting base and the fixing seat are fixedly provided on the support, the support is opened with a position-limit slot, the extending directions of the center line of the position-limit slot and the axis of the transmission shaft are the same, the mounting base and the fixing seat have position-limit protrusions thereon respectively cooperating with the position-limit slot, and each of the position-limit protrusions is stuck within the position-limit slot so as to arrange both the mounting base and the fixing seat along the center line of the position-limit slot.

According to a fourth aspect of the present disclosure, a retractable curtain comprises a curtain body and a cord for retracting the curtain body is provided, wherein the retractable curtain further comprises the retractor, and the cord is connected to the other one end of the winding shaft with a smaller outer diameter.

The present disclosure has the following advantages over the prior art: the winding shaft is provided at the two sides of the synchronizing wheel groups, the synchronizing wheels are connected with the transmission shaft via bevel gear groups engaged with each other, the winding shaft is driven by the transmission shaft to rotate, and the outer wall of the winding shaft is a slant surface, and the turns wound around the winding shaft earlier are pushed forwards by the turns wound later successively during rolling up to form single-layer winding, which avoids intertwining or tying occurring due to stacking of the cords and results in smooth retracting; the transmission direction is changed by the transmission assemblies, and the retractor has a reasonable arrangement and a compact structure.

Figure 1:
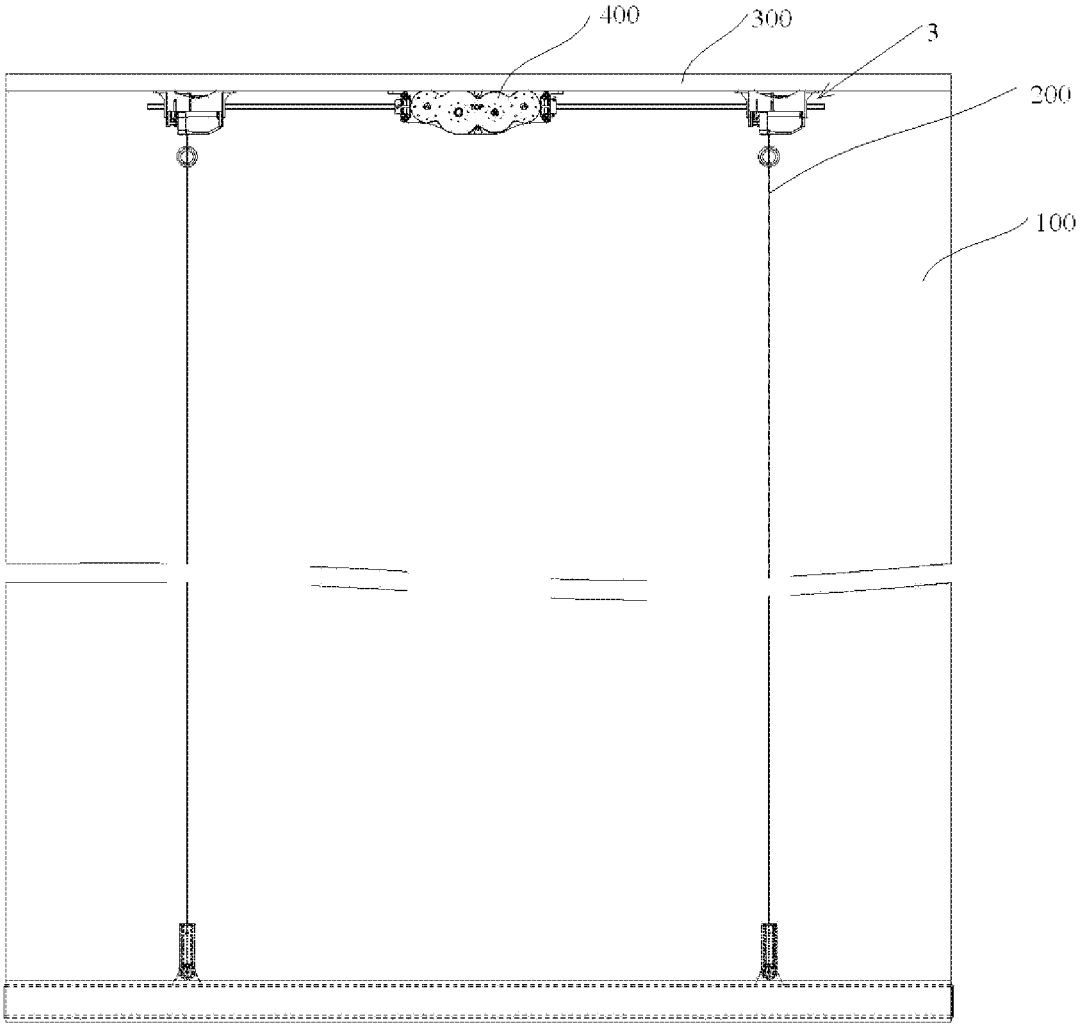
FIG. 1 is a schematic front view of a curtain after being opened of Embodiment 1 of the present invention.

In the above drawings,

100—curtain body; 200—cord; 300—support; 301—position-limit slot; 400—mounting base; 401—position-limit protrusion;

1—synchronizing wheel group; 11—synchronizing wheel; 12—coil spring; 13—gear teeth;

2—transmission assembly; 21—cylindrical gear; 22—first bevel gear; 23—second bevel gear;

3—winding assembly; 31—fixing seat; 310—threading hole; 311—guiding hole; 312—position-limit protrusion; 32—winding shaft; 33—transmission shaft.

DETAILED DESCRIPTION OF EXEMPLARY EMBODIMENTS

In the following, the preferable embodiments of the present invention are explained in detail combining with the accompanying drawings so that the advantages and features of the present invention can be easily understood by the skilled persons in the art.

Embodiment 1

FIGS. 1-8 show a retractable curtain of the present invention, and in particular a retractable Roman curtain.

Referring to FIGS. 1-8, the retractable curtain comprises a curtain body 100, cords 200 for retracting the curtain body 100, and a retractor for retracting the curtain cords 200. The cords 200 pass through the curtain body 100, and the lower ends of the cords 200 are fixedly connected with the lower end of the curtain body 100, the upper ends thereof are fixedly connected with the retractor. The upper end of the curtain body 100 is connected with a support 300 extending horizontally, and the retractor comprises the support 300, a mounting base 400 mounted on the support 300, synchronizing wheel group(s) 1, transmission assemblies 2 and winding assemblies 3, the left and right sides of each synchronizing wheel group 1 are respectively connected with one transmission assembly 2 for changing the transmission direction, and each winding assembly 3 is connected with at least one synchronizing wheel group 1 via at least one transmission assembly 2, respectively. The retractor has the following three configurations:

there is one synchronizing wheel group 1, the transmission assembly 2 at the left side of the synchronizing wheel group 1 is connected with one winding assembly 3, and the transmission assembly 2 at the right side of the synchronizing wheel group 1 is connected with another winding assembly 3; the present embodiment employs Configuration A, referring to FIGS. 1-6;

there is one synchronizing wheel group 1, the transmission assembly 2 at the left side and/or at the right side of the synchronizing wheel group 1 is connected with at least two winding assemblies 3;

there are several synchronizing wheel groups 1, and also several winding assemblies 3, the transmission assemblies 2 at the left and right sides of each synchronizing wheel group 1 are respectively connected with at least one winding assembly 3, wherein at least one winding assembly 3 is located between two adjacent synchronizing wheel groups 1.

Figure 7:
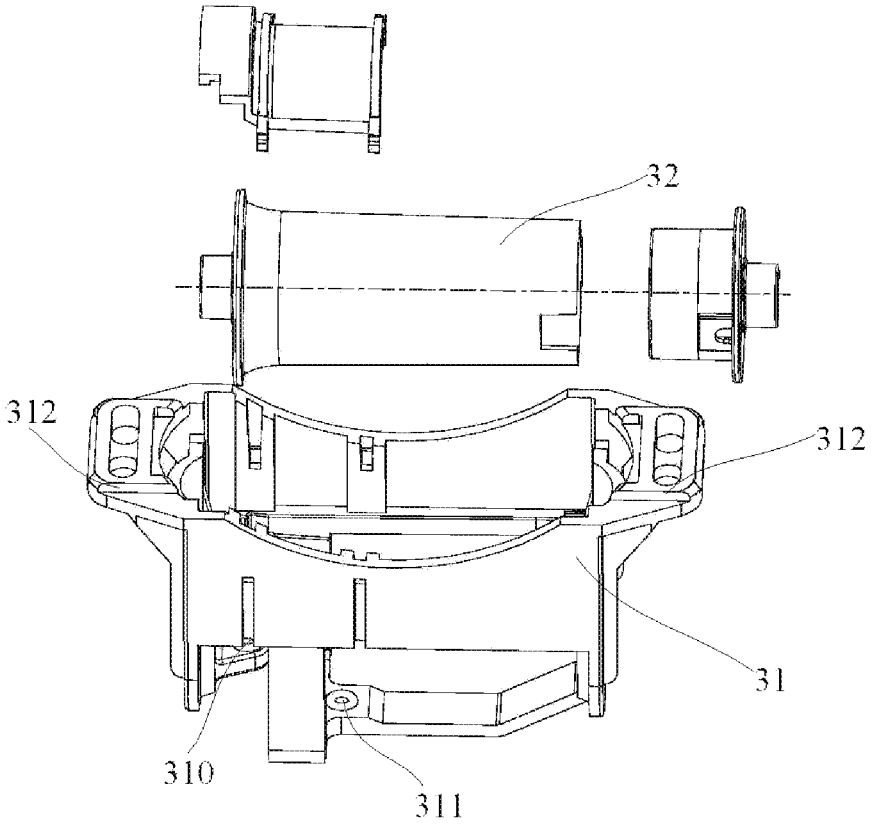
FIG. 7 is a schematic exploded diagram of a winding assembly of Embodiment 1 of the present invention.

The synchronizing wheel group 1 comprises at least one coil spring 12 and at least two synchronizing wheels 11, and the synchronizing wheels 11 are rotatably disposed on the mounting base 400. Two ends of each coil spring 12 are fixedly connected to two synchronizing wheels 11 respectively so as to be wound on the two synchronizing wheels 11 in opposite winding directions. Each of the transmission assemblies 2 comprises a first bevel gear 22 and a second bevel gear 23 which are engaged with each other, and the first bevel gears 22 of two transmission assemblies 2 at two sides of the synchronizing wheel group 1 are connected with at least one synchronizing wheel 11, wherein the first bevel gear 22 and the second bevel gear 23 are rotatably disposed on the mounting base 400, and the rotating axes of the first bevel gear 22 and the second bevel gear 23 are perpendicular to each other. Referring to FIG. 7, each of the winding assemblies 3 comprises a fixing seat 31 fixedly disposed on the upper end of the curtain body 100, and a winding shaft 32 and a transmission shaft 33 which are rotatably disposed on the fixing seat 31, the transmission shaft 33 is connected with a corresponding second bevel gear 23, and the extending directions of the rotating axes of all the winding assemblies are the same. The transmission shaft 33 passes though and is coaxial with the winding shaft 32, the outer wall of the winding shaft 32 tilts outward gradually along the axis of the transmission shaft 33, the upper end of the cord 200 is fixedly connected with the end of the winding shaft 32 with a smaller outer diameter, and one end of the fixing seat 31 corresponding to the winding shaft 32 with a larger outer diameter is opened with a threading hole 310 thereon for the cord 200 to pass through. And in the above Configuration B, if there are multiple winding assemblies 3 at the same side of the synchronizing wheels 11, the transmission shafts 33 of the multiple winding assemblies 3 may be the same shaft, and may also be multiple shafts connected successively.

Figure 5:
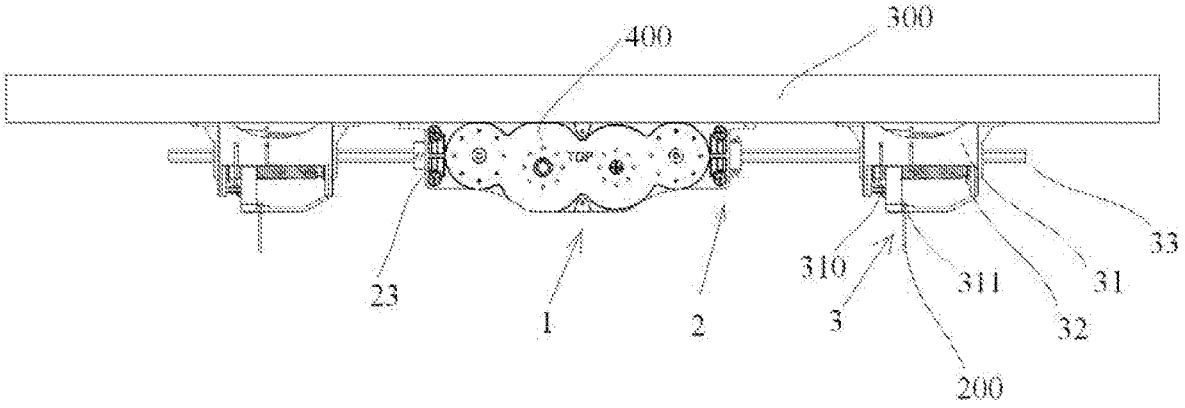
FIG. 5 is a schematic diagram of a retractor of Embodiment 1 of the present invention.
Figure 6:
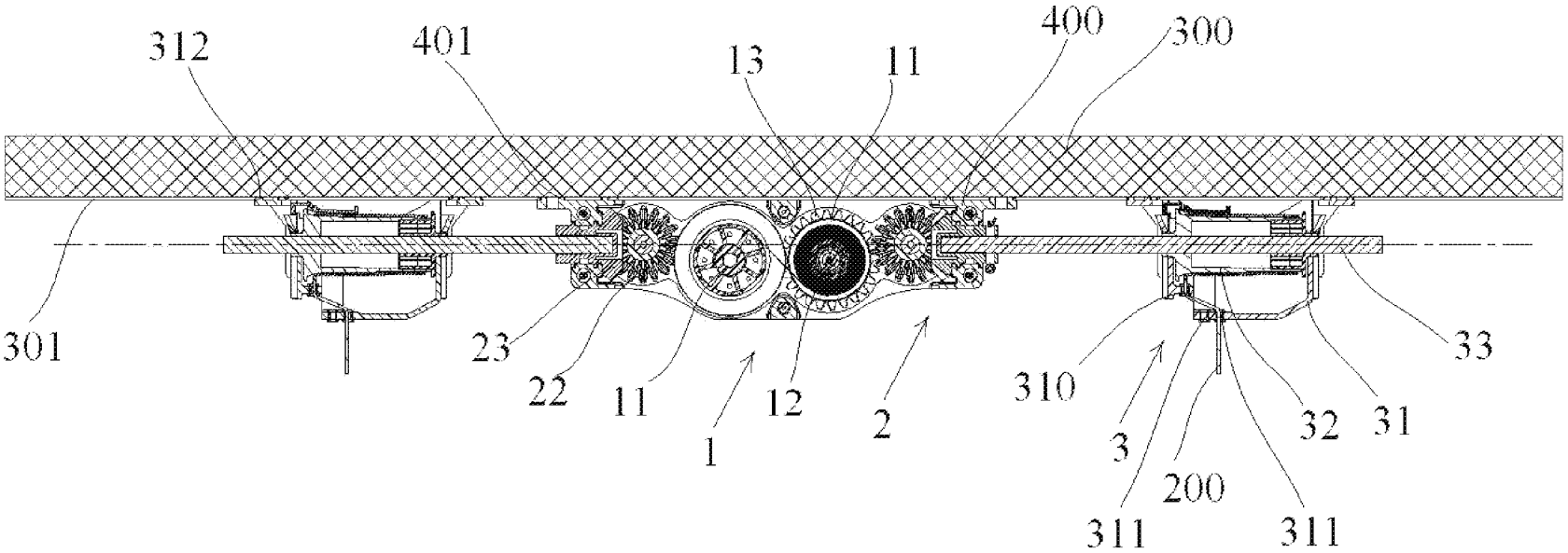
FIG. 6 is a sectional view of the retractor in FIG. 5.

Referring to FIGS. 5 and 6, the rotating axis of the synchronizing wheel 11 and the axis of the transmission shaft 33 are perpendicular to each other, and the axis of the transmission shaft 33 extends in a left-right direction. Specifically in the present embodiment, the rotating axis of the synchronizing wheel 11 and the axis of the transmission shaft 33 are both horizontal, and the rotating axis of the synchronizing wheel 11 extends in a front-rear direction.

Referring to FIG. 7, the fixing seat 31 is further opened with a plurality of guiding holes 311 located at different positions of the fixing seat 31, the threading hole 310 is located between the guiding holes 311 and the outer wall of the winding shaft 32, the upper end of the cord 200 is connected to the end of the winding shaft 32 with a smaller outer diameter after passing through one guiding hole 311 and the threading hole 310 successively, the cord 200 has different tensile force when passing through different guiding hole 311, such that the tensile force of the cord 200 may be adjusted according to the weight of the curtain body.

The section of the transmission shaft 33 is a polygon, and in particular a regular hexagon, the winding shaft 32 has a hole matched with the regular hexagon, and the winding shaft 32 is sleeved on the transmission shaft 33. And a hole matched with the regular hexagon is also opened on the second bevel gear 23, one end of the winding shaft 32 is inserted into the hole of the second bevel gear 23, and the second bevel gear 23, the transmission shaft 33 and the winding shaft 32 are coaxial.

Figure 8:
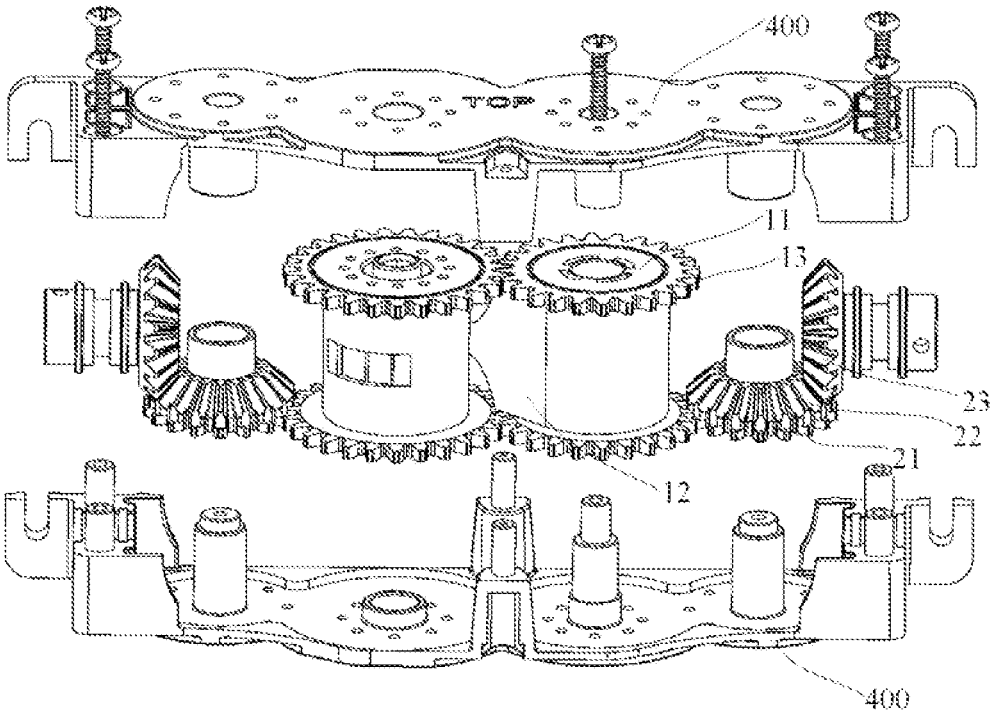
FIGS. 8 and 9 are schematic diagrams of a synchronizing wheel of Embodiment 1 of the present invention from two viewing angles.
Figure 9:
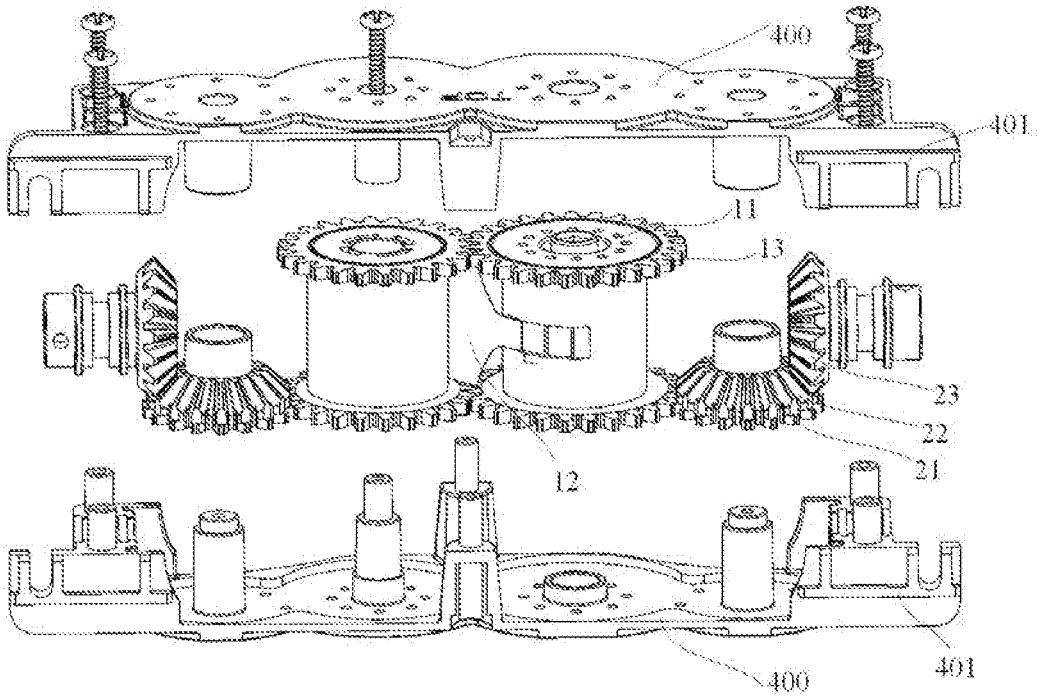

The synchronizing wheels 11 and the coil spring 12 have many kinds of combinations, for example:

Referring to FIGS. 8 and 9, there are two synchronizing wheels 11, the outer wall of each of the synchronizing wheels 11 is provided with a circle of gear teeth 13, the two synchronizing wheels 11 are engaged with each other via the gear teeth 13, one coil spring 12 is wound on the two synchronizing wheels 11, and each synchronizing wheel 11 is respectively connected with one first bevel gears 22.

Figure 10:
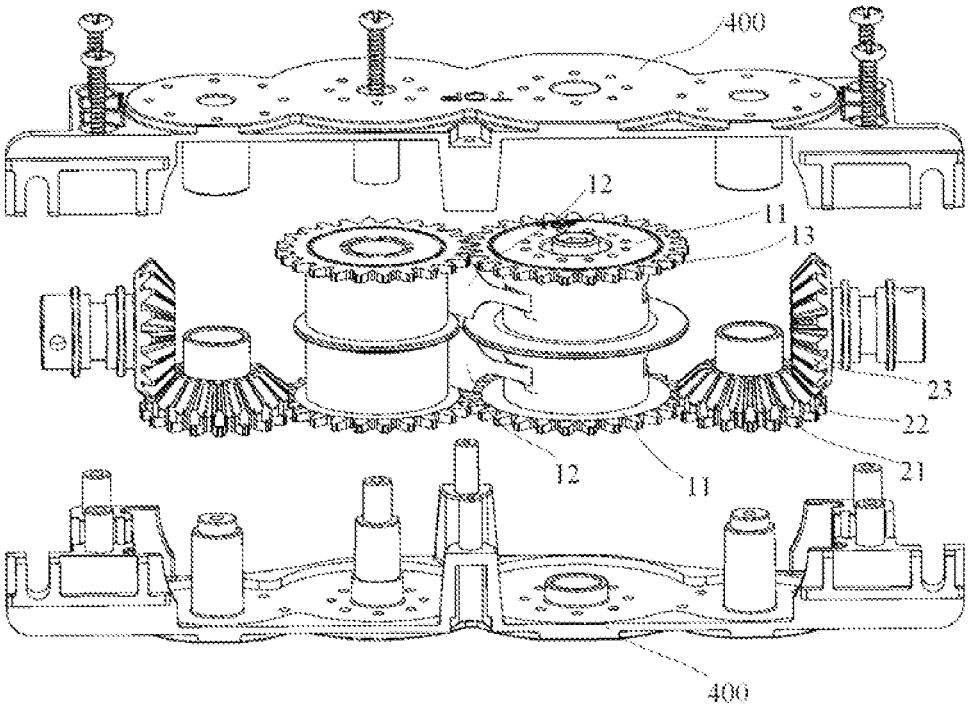
FIGS. 10-13 are schematic diagrams of another kinds of synchronizing wheels of the present invention.
Figure 11:
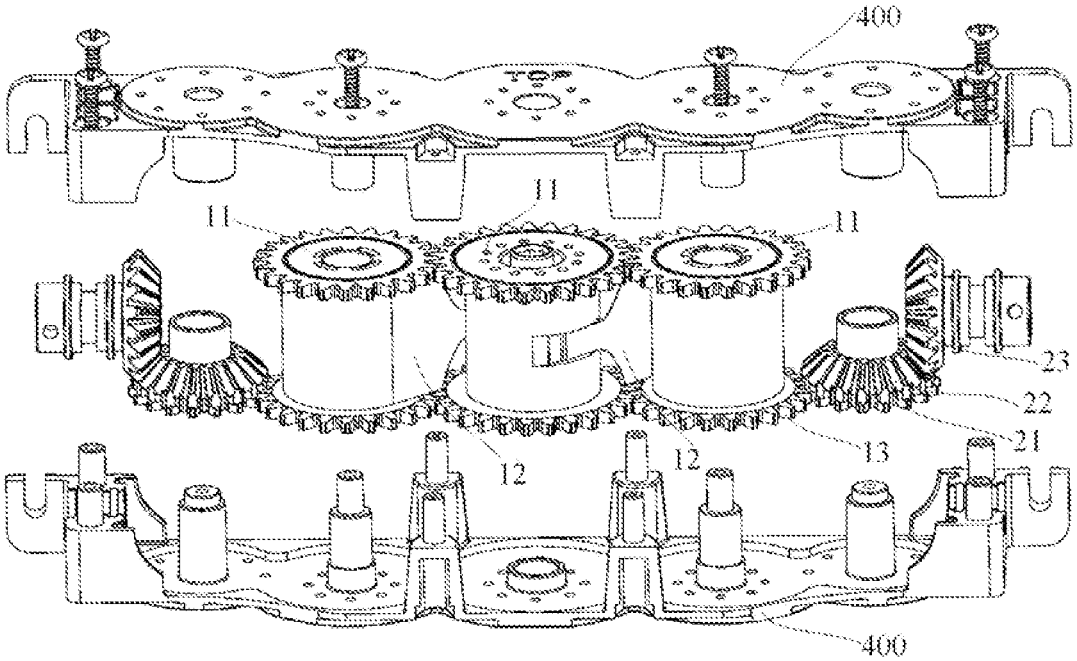
Figure 12:
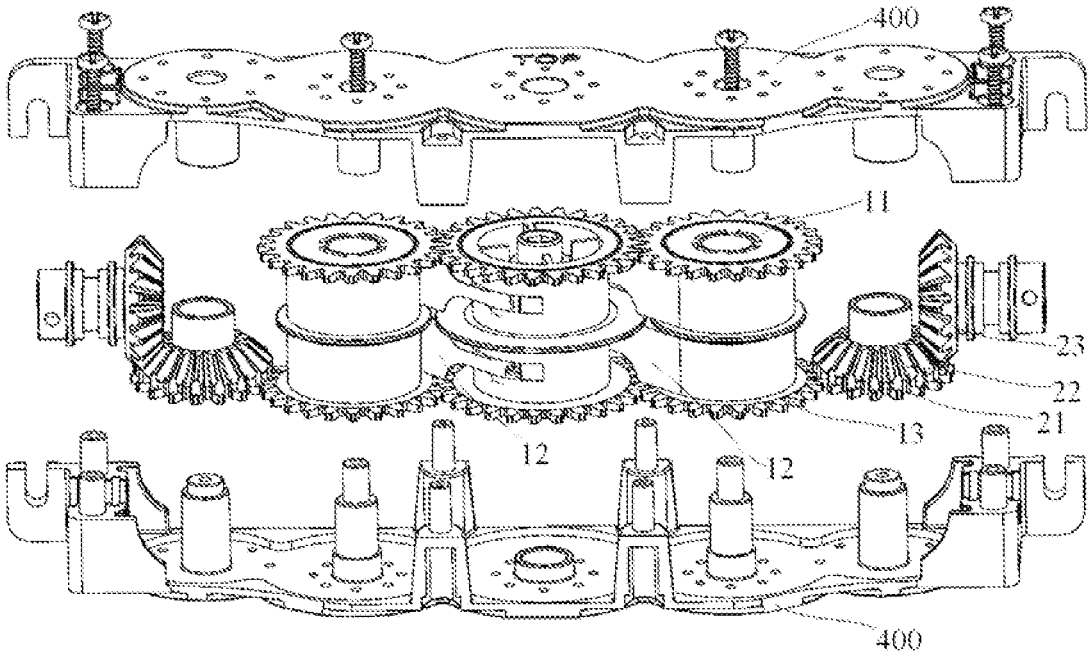
Figure 13:
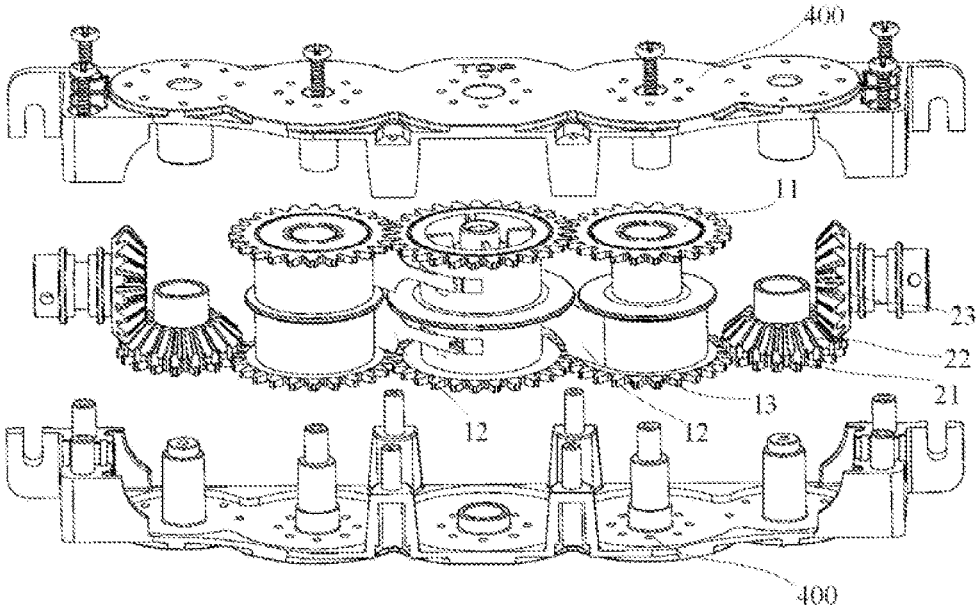

Referring to FIG. 10, there are two groups of synchronizing wheels 11, each group of synchronizing wheels 11 has two synchronizing wheels 11, the two synchronizing wheels 11 in each group of synchronizing wheels 11 are coaxial and arranged along the axis thereof successively, the outer wall of at least one synchronizing wheel 11 in each group of synchronizing wheels 11 is provided with a circle of gear teeth 13, the two groups of synchronizing wheels 11 are engaged with each other via the gear teeth 13, one synchronizing wheel 11 in each of the two groups of synchronizing wheels 11 is connected with the two ends of the first coil spring 12 and the first coil spring 12 is wound on the two synchronizing wheels 11, the two ends of the second coil spring 12 are respectively fixedly connected with the other synchronizing wheels 11 in the two groups of synchronizing wheels 11 and the second coil spring 12 is wound on the two synchronizing wheels 11, the first bevel gear 22 at the left side is connected with one synchronizing wheel 11 of the left group of synchronizing wheels 11, and the first bevel gear 22 at the right side is connected with one synchronizing wheel 11 of the right group of synchronizing wheels 11;

Referring to FIG. 11, there are three synchronizing wheels 11, the outer walls of the three synchronizing wheels 11 are each provided with a circle of gear teeth 13, the three synchronizing wheels 11 are engaged with each other via the gear teeth 13 successively, the synchronizing wheel 11 at the leftmost is connected with the first bevel gear 22 at the left side correspondingly, and the synchronizing wheel 11 at the rightmost is connected with the first bevel gear 22 at the right side correspondingly; there are two coil springs 12, two ends of one of the coil springs 12 are respectively fixedly connected with the synchronizing wheel 11 in the middle and the synchronizing wheel 11 at the left side, two ends of the other one of the coil springs 12 are respectively fixedly connected with the synchronizing wheel 11 in the middle and the synchronizing wheel 11 at the right side, and the two coil springs 12 are stacked and wound on the synchronizing wheel 11 in the middle;

Referring to FIG. 12, there are three groups of synchronizing wheels 11, each group of synchronizing wheels 11 has two synchronizing wheels 11, the two synchronizing wheels 11 in each group of synchronizing wheels 11 are coaxial and arranged along the axis thereof successively, at least one synchronizing wheel 11 in each group of synchronizing wheels 11 is provided with gear teeth 13, the three groups of synchronizing wheels 11 are engaged with each other via the gear teeth 13, there are four coil springs 12 wound on the three groups of synchronizing wheels 11, and wound manner is the same as shown in FIG. 11;

Referring to FIG. 13, the difference between the manners in it and FIG. 12 is that there are three coil springs 12 wound on the three groups of synchronizing wheels 11, wherein no coil spring 12 is wound on two synchronizing wheels 11 respectively belonging to two groups of synchronizing wheels 11;

By adjusting the number of the synchronizing wheels and the number of the coil springs, the above mentioned several manners may be suitable for curtain bodies with different weights, that is, the weight of the curtain body may be adjusted.

The synchronizing wheel 11 and the first bevel gear 22 are uncoaxial, the rotating axis of the synchronizing wheel 11 and the axis of the first bevel gear are parallel to each other, and the synchronizing wheel 11 and the first bevel gear 22 are connected via a cylindrical gear 21. Specifically, the synchronizing wheel 11 is engaged with the cylindrical gear 21 via gear teeth, and the cylindrical gear 21 is coaxial with the first bevel gear 22, and specifically in the present embodiment, the cylindrical gear 21 and the first bevel gear 22 are plastic injection molded integrally or cast formed integrally. In the present embodiment, the first bevel gear 22 and the second bevel gear 23 are both 90 degree bevel gears.

Referring to FIGS. 6, 7 and 9, the upper surface of the support 300 is opened with a position-limit slot 301 extending along the left-right direction of the curtain, the extending directions of the center line of the position-limit slot 301 and the axis of the transmission shaft 33 are the same, the position-limit slot 301 is a rectangular slot, the lower surface of the mounting base 400 has a position-limit protrusion 401 cooperating with the width of the position-limit slot 301, the lower surface of the fixing seat 31 also has a position-limit protrusion 312 cooperating with the width of the position-limit slot 301, the mounting base 400 and the fixing seat 31 are fixedly connected to the support 300 via screws, and each of the position-limit protrusions 401 and 312 is just stuck within the position-limit slot 301 so as to arrange both the mounting base 400 and the fixing seat 31 along the center line of the position-limit slot 301, to avoid the shift of the transmission shaft 33 and the transmission assemblies 2.

Figure 2:
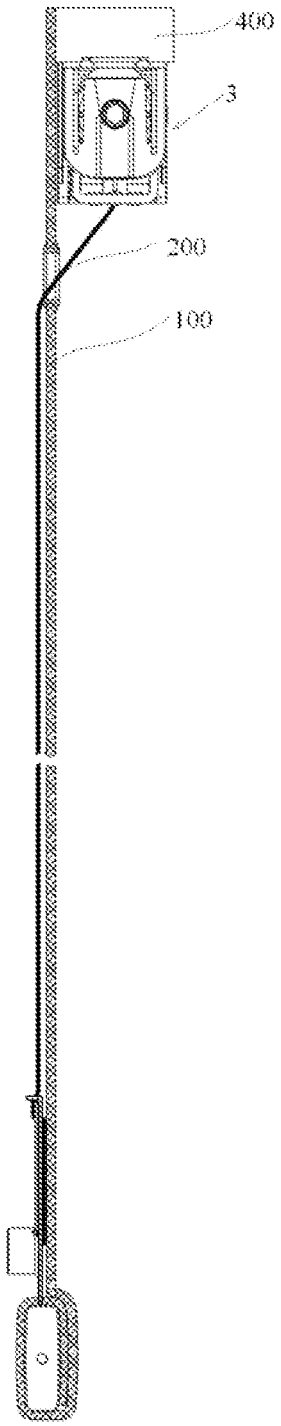
FIG. 2 is a schematic side view of the curtain after being opened of Embodiment 1 of the present invention.

The working process of the retractable curtain is as follows: drawing the curtain body 100 downwards, unwinding the cord 200, driving the winding shaft 32 to rotate, rotating the transmission shaft 33, changing the transmission direction by 90 degrees via the transmission assembly 2, driving the synchronizing wheels 11 to rotate, gradually unwinding the coil spring 12 from one of the synchronizing wheels 11 and winding it onto the other synchronizing wheel 11 in an opposite direction, and deformation happens to generate an elastic force, due to that this elastic force is not enough to overcome the gravity of the curtain body 100, the curtain body 100 is in an opened state, as shown in FIGS. 1 and 2.

Figure 3:
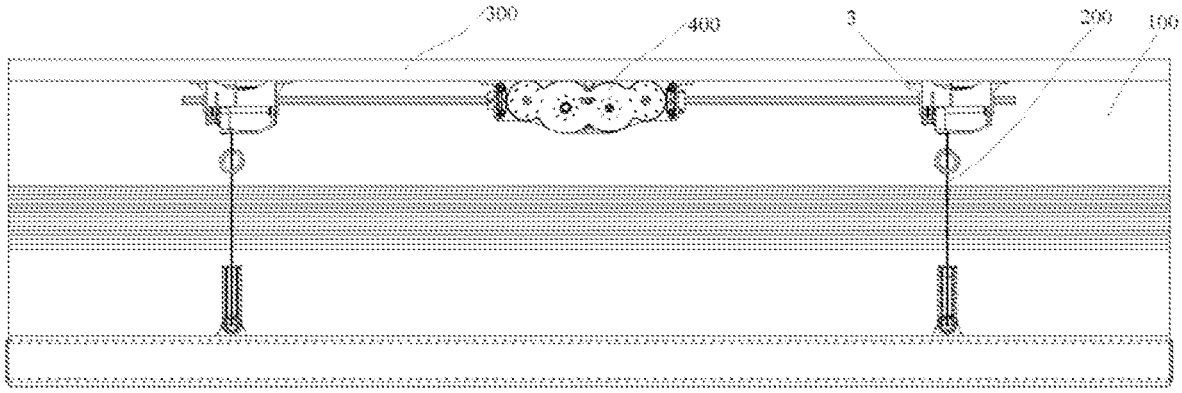
FIG. 3 is a schematic front view of the curtain after being rolled up of Embodiment 1 of the present invention.
Figure 4:
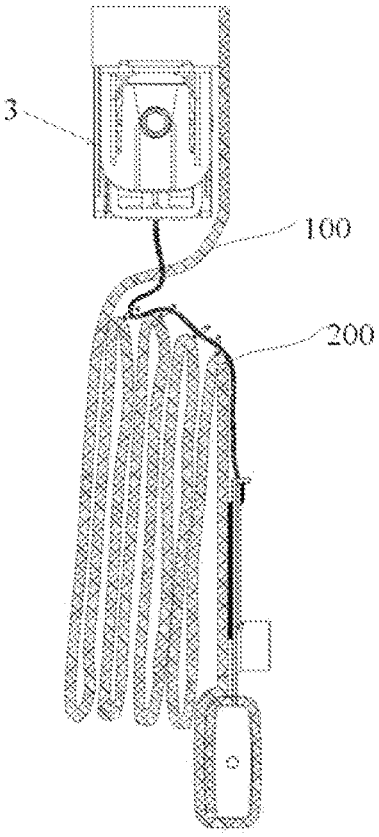
FIG. 4 is a schematic side view of the curtain after being rolled up of Embodiment 1 of the present invention.

By holding or pushing the curtain body 100 upwards, that is, by applying a small thrust on the curtain body 100, a resultant force of this thrust and the elastic force of the coil spring 12 is enough to overcome the gravity of the curtain body 100, the coil spring is reset, the synchronizing wheels 11 rotate in an opposite direction, the winding shaft 21 rotates to roll up the cord 200, and the curtain body is rolled up with it, as shown in FIGS. 3 and 4.

Due to that the outer wall of the winding shaft 32 is a slant surface, and the turns wound around the winding shaft 32 earlier are pushed forwards by the turns wound later successively during rolling up to form single-layer winding, which avoids intertwining or tying occurring due to stacking of the cords 200 and results in smooth retracting; meanwhile, by changing the transmission direction via the transmission assemblies 2, the retractor has a reasonable arrangement and a compact structure.

Embodiment 2

Figure 14:
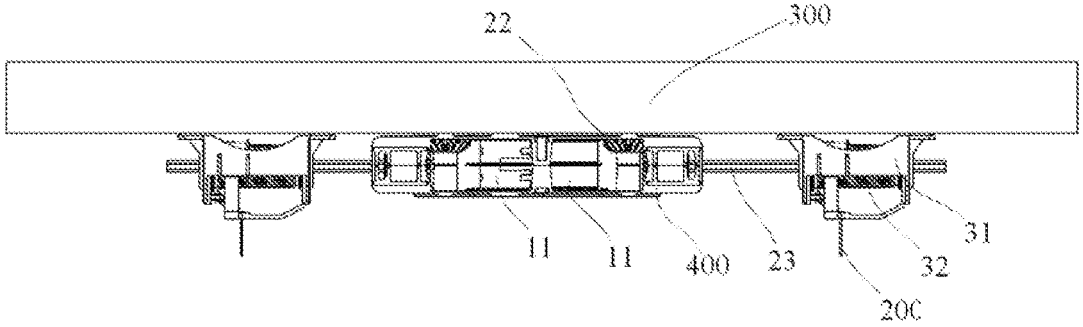
FIG. 14 is a schematic diagram of a retractor of Embodiment 2 of the present invention.

Referring to FIG. 14, the distinction between the present embodiment and Embodiment 1 is only that: the rotating axis of the synchronizing wheels are vertical, that is, extends along a up-down direction.

Embodiment 3

Figure 15:
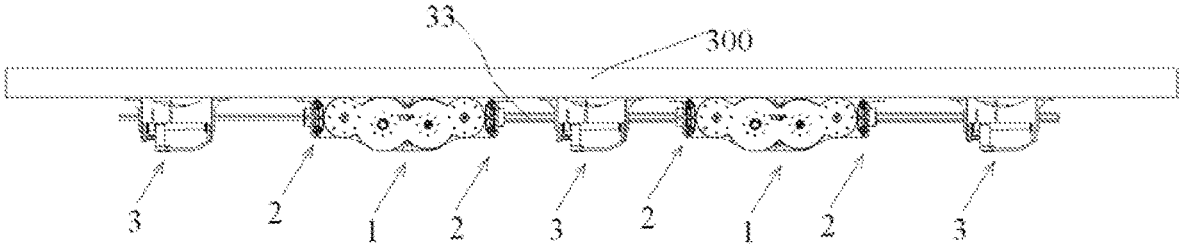
FIG. 15 is a schematic diagram of a retractor of Embodiment 3 of the present invention.

Referring to FIG. 15, the distinction between the present embodiment and Embodiment 1 is only that: the retractor is disposed according to the above Configuration C, that is, there are several synchronizing wheel groups 1, and also several winding assemblies 3, the transmission assemblies 2 at the left and right sides of each synchronizing wheel group 1 are respectively connected with at least one winding assembly 3, wherein one or more winding assembly(s) 3 is located between two adjacent synchronizing wheel groups 1.

Specifically in the present embodiment, one winding assembly 3 is respectively disposed at the left and right sides of each synchronizing wheel group 1, wherein the two ends of the transmission shaft 33 of the winding assembly 3 located between the opposite transmission assemblies 2 of two synchronizing wheel groups 1 are respectively connected with the second bevel gears 23 of these two transmission assemblies 2.

The embodiments described above are only for illustrating the technical concepts and features of the present invention, are preferred embodiments, and are intended to make those skilled in the art being able to understand the present invention and thereby implement it, and should not be concluded to limit the protective scope of this invention. Any equivalent variations or modifications according to the present invention should be covered by the protective scope of the present invention.

What is claimed is:

1. A retractor for retracting a curtain cord, comprising a synchronizing wheel group, and transmission assemblies located at two sides of the synchronizing wheel group for changing transmission direction, wherein each transmission assembly is connected with at least one winding assembly, wherein the synchronizing wheel group comprises at least one coil spring and at least two units of synchronizing wheels, and two ends of each coil spring are fixedly connected to two units of synchronizing wheels respectively so as to be wound on the two units of synchronizing wheels in opposite winding directions, each unit of synchronizing wheels comprises at least one synchronizing wheel;

each transmission assembly comprises a first bevel gear and a second bevel gear which are engaged with each other, and the first bevel gears of the transmission assemblies are connected with at least one unit of the at least two units of synchronizing wheels; each first bevel gear and the unit of synchronizing wheels which is connected with the first bevel gear are non-coaxial, and the first bevel gear and the unit of synchronizing wheels are connected via a cylindrical gear, the first bevel gear and the cylindrical gear are engaged with each other;

each winding assembly comprises a fixing seat, and a winding shaft and a transmission shaft which are rotatably provided on the fixing seat, the transmission shaft is connected with the second bevel gear, the transmission shaft passes through and is coaxial with the winding shaft, the winding shaft is in the fixing seat, an outer wall of the winding shaft tilts outward gradually along an axis of the transmission shaft, and a threading hole for the cord to pass through is opened on a part of the fixing seat corresponding to one end of the winding shaft with a larger outer diameter;

extending directions of a rotating axis of the synchronizing wheel and the axis of the transmission shaft are different.

2. The retractor according to claim 1, wherein each unit of synchronizing wheels comprises at least two synchronizing wheels, all synchronizing wheels in each unit of synchronizing wheels are coaxial and are successively arranged along the rotating axis thereof, and one end of the coil spring is connected to one synchronizing wheel in one unit of synchronizing wheels, and the other end is connected to one synchronizing wheel in another unit of synchronizing wheels.

3. The retractor according to claim 1, wherein the synchronizing wheel group comprises at least a pair of units of synchronizing wheels, and one coil spring is wound on each pair of units of synchronizing wheels.

4. The retractor according to claim 1, wherein the synchronizing wheel group comprises at least three units of synchronizing wheels, the at least three units of synchronizing wheels are set in parallel, a unit of synchronizing wheels located in middle is wounded with two coil springs to drive units of synchronizing wheels at two sides thereof respectively.

5. The retractor according to claim 1, wherein the outer wall of the synchronizing wheel is provided with a circle of gear teeth, and two adjacent units of the at least two units of synchronizing wheels are engaged with each other via the gear teeth, and two units of synchronizing wheels at two sides are connected with the first bevel gears at corresponding sides, respectively.

6. The retractor according to claim 1, wherein the rotating axis of each synchronizing wheel and the axis of the transmission shaft are perpendicular to each other.

7. The retractor according to claim 1, wherein a cross section of the transmission shaft is a polygon, the winding shaft has a hole matched with the polygon, and the transmission shaft passes through the hole.

8. The retractor according to claim 1, wherein the fixing seat is opened with a plurality of guiding holes, the plurality of guiding holes are opened at different positions of the fixing seat, and the threading hole is located between the guiding holes and the outer wall of the winding shaft.

9. The retractor according to claim 1, wherein the extending directions of the rotating axes of the transmission shafts of the respective winding assemblies are the same, and the retractor further comprises a support for connecting to a curtain body and a mounting base for mounting the synchronizing wheels and the transmission assemblies, the mounting base and the fixing seat are fixedly provided on the support, the support is opened with a position-limit slot, extending directions of a center line of the position-limit slot and the axis of the transmission shaft are the same, the mounting base and the fixing seat have position-limit protrusions thereon respectively cooperating with the position-limit slot, and each of the position-limit protrusions is stuck within the position-limit slot so as to arrange both the mounting base and the fixing seat along the center line of the position-limit slot.

10. A retractable curtain, comprising a curtain body and a cord for retracting the curtain body, wherein the retractable curtain further comprises the retractor according to claim 1, and the cord is connected to the other one end of the winding shaft with a smaller outer diameter.

* * * * *